US006983508B2

(12) United States Patent
Saurer

(10) Patent No.: US 6,983,508 B2
(45) Date of Patent: Jan. 10, 2006

(54) BOLT CLEANING SYSTEM

(76) Inventor: James M. Saurer, P.O. Box 3744, Pikeville, KY (US) 41501

( * ) Notice: Subject to any disclaimer, the term of this patent is extended or adjusted under 35 U.S.C. 154(b) by 352 days.

(21) Appl. No.: 10/224,838

(22) Filed: Aug. 19, 2002

(65) Prior Publication Data

US 2004/0031112 A1 Feb. 19, 2004

(51) Int. Cl.
*B08B 9/02* (2006.01)

(52) U.S. Cl. ..... 15/104.04; 15/88

(58) Field of Classification Search ..... 15/88, 15/104.03, 104.04

See application file for complete search history.

(56) References Cited

U.S. PATENT DOCUMENTS

| | | | | |
|---|---|---|---|---|
| 490,682 | A * | 1/1893 | Roemer | 15/191.1 |
| 3,088,150 | A | 5/1963 | Sweeney | |
| 3,188,674 | A | 6/1965 | Hobbs | |
| 4,301,567 | A | 11/1981 | Tucker | |
| 5,038,525 | A | 8/1991 | Gardner | |
| 5,168,660 | A | 12/1992 | Smith | |
| 5,269,104 | A * | 12/1993 | DiBiagio | 451/344 |
| 5,307,534 | A | 5/1994 | Miller | |
| 5,566,416 | A | 10/1996 | Karls | |
| 5,946,757 | A | 9/1999 | Oliveira | |
| 6,553,601 | B1 * | 4/2003 | Major | 15/104.04 |
| 6,745,425 | B1 * | 6/2004 | Tope | 15/104.04 |

FOREIGN PATENT DOCUMENTS

| | | | |
|---|---|---|---|
| GB | 2 147 835 | * | 5/1985 |

* cited by examiner

*Primary Examiner*—Randall Chin

(57) ABSTRACT

A bolt cleaning system for removing debris from the threaded portions of anchor bolts. The bolt cleaning system includes a shaft member, an inner member attached to the shaft member having an annular member, a first cleaning unit removably positionable within the inner member, a connector member connectable to the inner member, an outer member connectable to the connector member, and a second cleaning unit removably positioned between the connector member and the outer member.

10 Claims, 6 Drawing Sheets

BOLT CLEANING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to anchor bolt cleaning devices and more specifically it relates to a bolt cleaning system for removing debris from the threaded portions of anchor bolts.

2. Description of the Related Art

Anchor bolts positioned within concrete during pouring often times become contaminated with concrete, dirt and other debris. Threaded studs welded to a structure also require cleaning of excess weld and debris accumulated upon the threaded portions thereof. Conventional methods of cleaning anchor bolts and other devices involves using a wire brush which is labor intensive and time consuming. In addition, using a wire brush often times does not completely clean the threaded portions.

Examples of patented devices which may be related to the present invention include U.S. Pat. No. 5,946,757 to Oliveira; U.S. Pat. No. 3,188,674 to Hobbs; U.S. Pat. No. 4,301,567 to Tucker; U.S. Pat. No. 5,168,660 to Smith; U.S. Pat. No. 5,566,416 to Karls; U.S. Pat. No. 5,307,534 to Miller; U.S. Pat. No. 3,088,150 to Sweeney; and U.S. Pat. No. 5,038,525 to Gardner.

While these devices may be suitable for the particular purpose to which they address, they are not as suitable for removing debris from the threaded portions of anchor bolts. Conventional cleaning devices are not suitable for extended usage in cleaning the threaded portions of anchor bolts.

In these respects, the bolt cleaning system according to the present invention substantially departs from the conventional concepts and designs of the prior art, and in so doing provides an apparatus primarily developed for the purpose of removing debris from the threaded portions of anchor bolts.

BRIEF SUMMARY OF THE INVENTION

In view of the foregoing disadvantages inherent in the known types of thread cleaning devices now present in the prior art, the present invention provides a new bolt cleaning system construction wherein the same can be utilized for removing debris from the threaded portions of anchor bolts.

The general purpose of the present invention, which will be described subsequently in greater detail, is to provide a new bolt cleaning system that has many of the advantages of the cleaning devices mentioned heretofore and many novel features that result in a new bolt cleaning system which is not anticipated, rendered obvious, suggested, or even implied by any of the prior art anchor bolt cleaning devices, either alone or in any combination thereof.

To attain this, the present invention generally comprises a shaft member, an inner member attached to the shaft member having an annular member, a first cleaning unit removably positionable within the inner member, a connector member connectable to the inner member, an outer member connectable to the connector member, and a second cleaning unit removably positioned between the connector member and the outer member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a bolt cleaning system that will overcome the shortcomings of the prior art devices.

A second object is to provide a bolt cleaning system for removing debris from the threaded portions of anchor bolts.

Another object is to provide a bolt cleaning system that allows for the changing of cleaning bristles after being worn.

An additional object is to provide a bolt cleaning system that effectively removes concrete, dirt and dust from the threaded portions of anchor bolts retained within concrete.

A further object is to provide a bolt cleaning system that is capable of cleaning various sizes and lengths of anchor bolts.

Another object is to provide a bolt cleaning system that may be utilized to clean various types of threaded or non-threaded devices.

A further object is to provide a bolt cleaning system that provides for efficient cleaning of anchor bolts.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
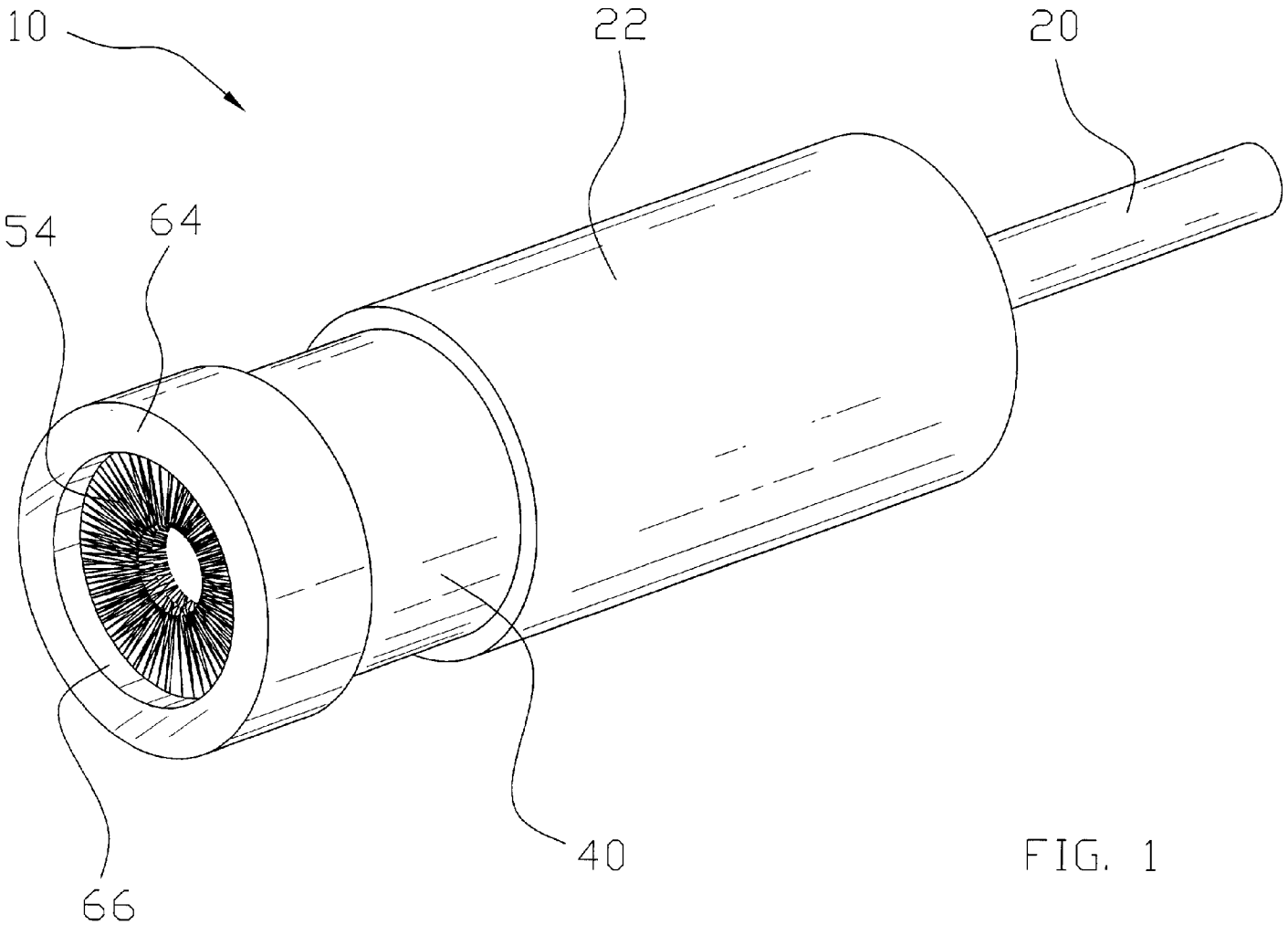
FIG. 1 is an upper perspective view of the present invention.

Turning now descriptively to the drawings, in which similar reference characters denote similar elements throughout the several views, FIGS. 1 through 6 illustrate a bolt cleaning system 10, which comprises a shaft member 20, an inner member 22 attached to the shaft member 20 having an annular member 24, a first cleaning unit 30 removably positionable within the inner member 22, a connector member 40 connectable to the inner member 22, an outer member 60 connectable to the connector member 40, and a second cleaning unit 50 removably positioned between the connector member 40 and the outer member 60.

Figure 2:
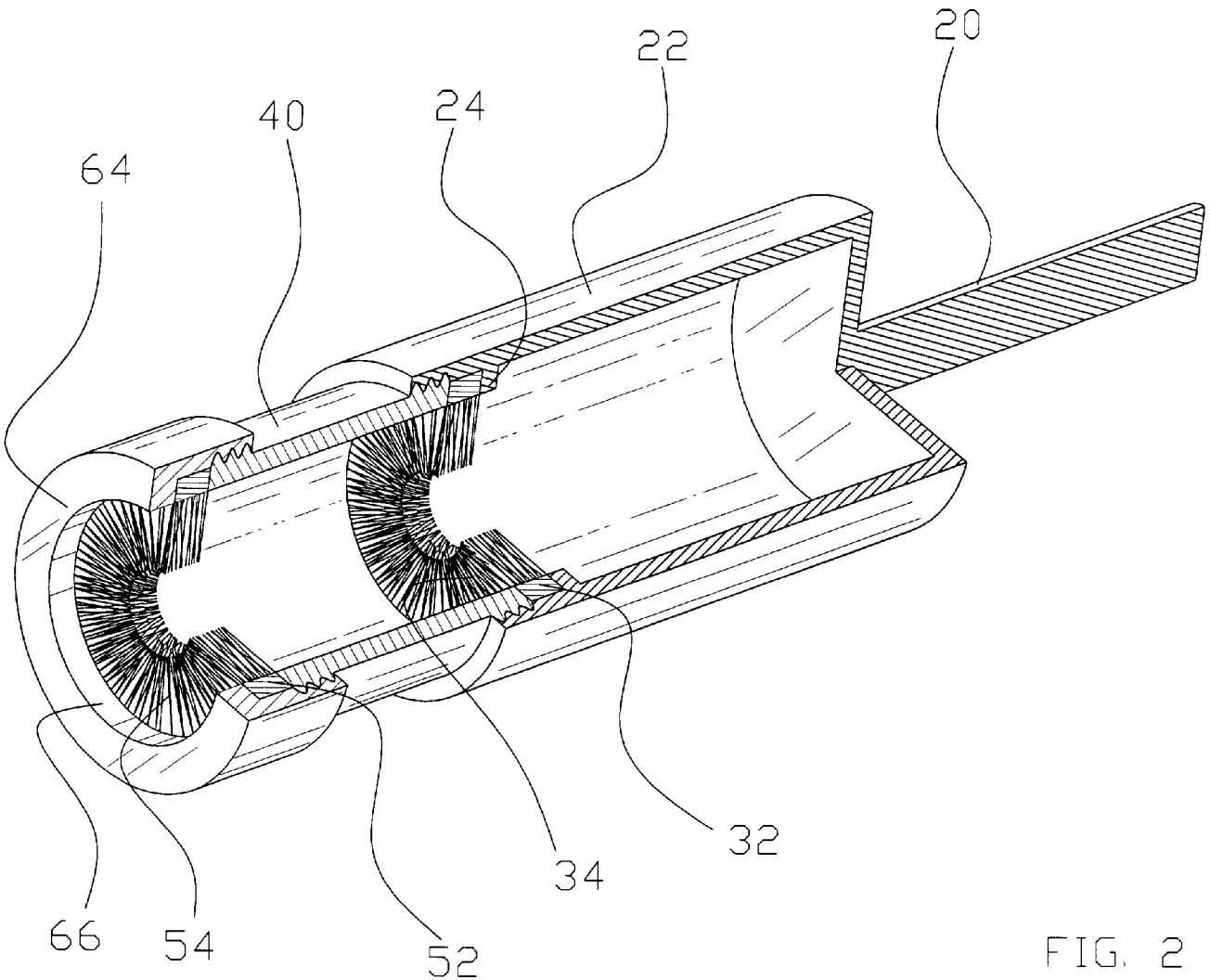
FIG. 2 is a cutaway upper perspective view of the present invention.
Figure 3:
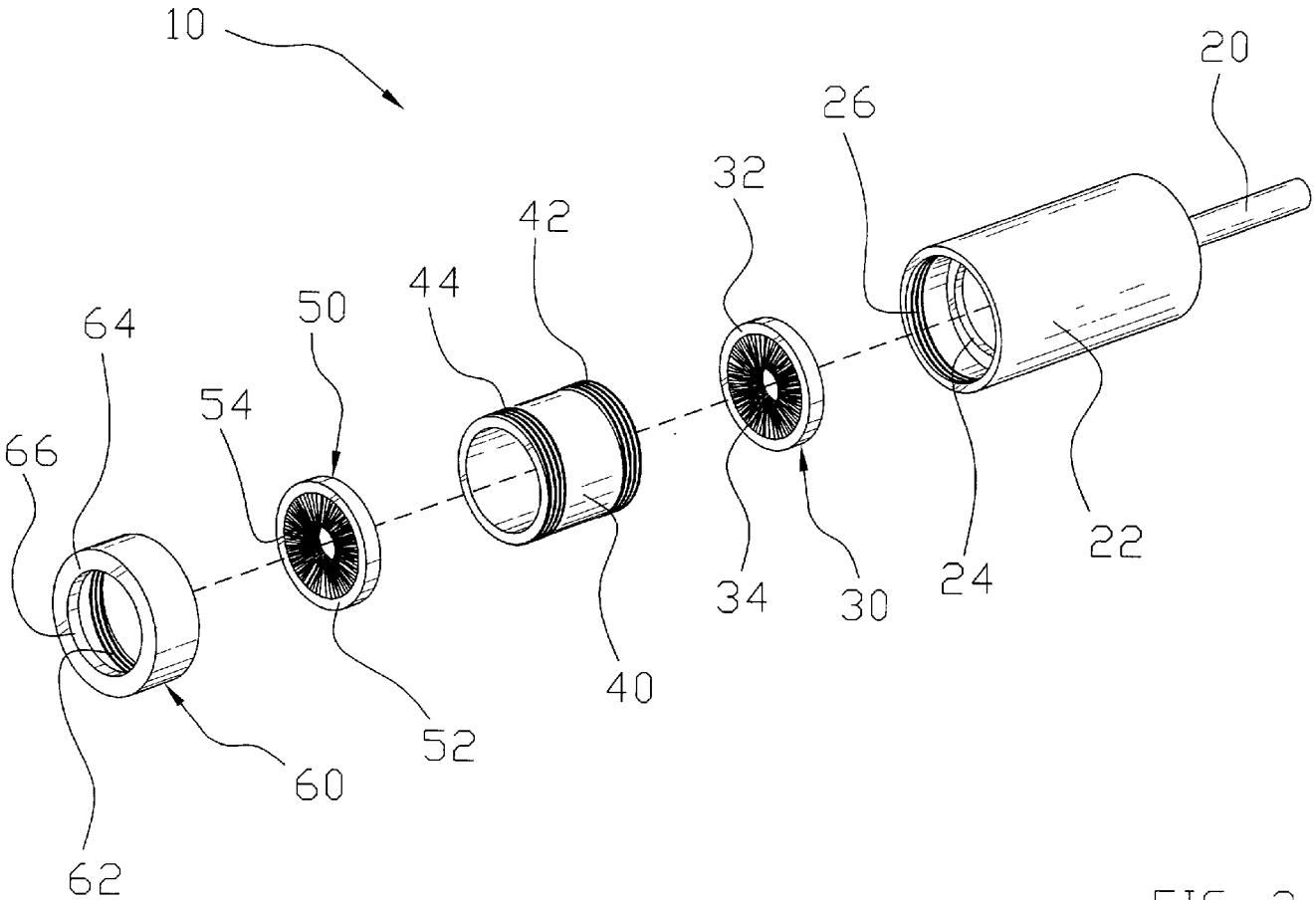
FIG. 3 is an exploded upper perspective view of the present invention.
Figure 4:
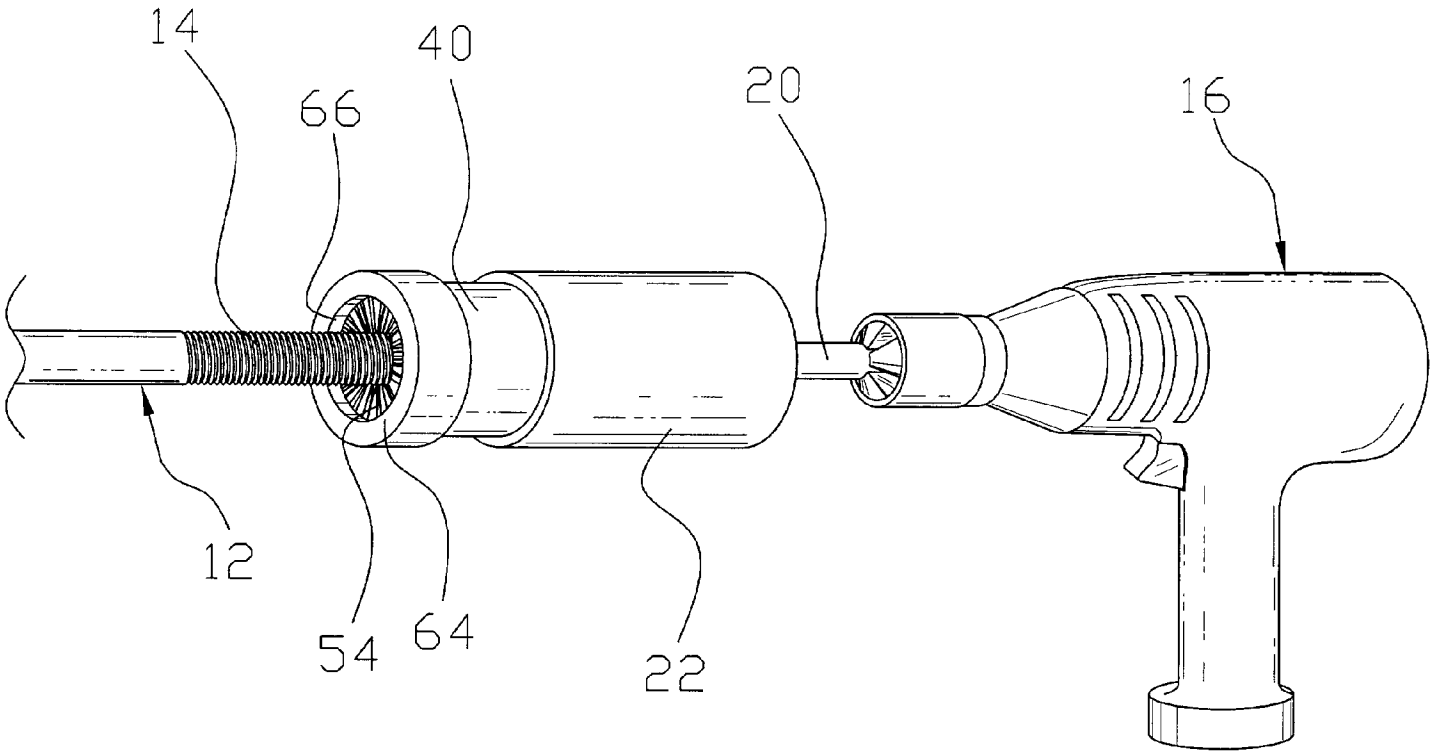
FIG. 4 is a side perspective view of the present invention attached to a drive unit and positioned about the bolt.

As shown in FIGS. 1 through 3 of the drawings, the shaft member 20 is comprised of an elongate rigid structure. The shaft member 20 is preferably positionable and connectable within a coupler of a conventional drive unit 16 such as an air drill, electric drill or hand drill. The shaft member 20 may have various cross sectional shapes commonly utilized within the tool industry to connect to drive units 16.

An inner member 22 having a tubular structure is attached to the shaft member 20 as best illustrated in FIG. 2 of the drawings. The inner member 22 extends a finite distance and is formed for receiving a distal portion of a bolt 12 being cleaned. The inner member 22 has an open end with an inner lumen as best illustrated in FIGS. 2 and 3 of the drawings. A first inner threading 26 is positioned within the distal portion of the inner lumen of the inner member 22 for threadably receiving the connector member 40 as shown in FIG. 3 of the drawings.

An annular member 24 extends inwardly from the inner lumen of the inner member 22 as illustrated in FIGS. 2 and 3 of the drawings. The annular member 24 forms a lip that the first cleaning unit 30 is positionable against but which cannot extend through. The annular member 24 is positioned a finite distance within the inner member 22 to allow for the connector member 40 to tightly retain the first cleaning unit 30 between thereof as shown in FIG. 2 of the drawings.

As shown in FIG. 3 of the drawings, the first cleaning unit 30 is comprised of a first outer member 32 and a plurality of first bristles 34 extending inwardly from the first outer member 32. The first outer member 32 is comprised of a ring structure that is snugly positionable within the inner member 22 as illustrated in FIG. 2 of the drawings. The plurality of first bristles 34 are comprised of a resilient material capable of cleaning the threaded portion 14 of the bolt 12 such as but not limited to metal wire or plastic. The plurality of first bristles 34 preferably extend inwardly from the first outer member 32 and preferably form a first center opening within for receiving the threaded portion 14 of the bolt 12 during cleaning. The first center opening of the first cleaning unit 30 may have various diameters based upon the size of the bolt 12 to be cleaned.

The connector member 40 is a tubular structure having a first outer threading 42 and a second outer threading 44 on opposing sides thereof as best shown in FIG. 3 of the drawings. The first outer threading 42 is threadably connectable to the first inner threading 26 of the inner member 22 as shown in FIG. 2 of the drawings. The connector member 40 is tightened within the first inner threading 26 until tightly positioned against the first cleaning unit 30 thereby retaining the first cleaning unit 30 in a non-movable position against the annular member 24. The second outer threading 44 is threadably connectable to the second inner threading 62 of the outer member 60 as shown in FIGS. 2 and 3 of the drawings.

The outer member 60 is comprised of a tubular structure having a second inner threading 62 and a flanged portion 64 forming a receiver opening 66. The receiver opening 66 is sufficient in size for receiving the bolt 12 without engaging the bolt 12 directly during rotation of the bolt 12 cleaning system 10. The flanged portion 64 retains the second cleaning unit 50 against the end of the connector member 40 when the second outer threading 44 is threadably connected to the second inner threading 62.

As shown in FIG. 3 of the drawings, the second cleaning unit 50 is comprised of a second outer member 52 and a plurality of second bristles 54 extending inwardly from the second outer member 52 similar to the first cleaning unit 30. The second outer member 52 is comprised of a ring structure that is snugly positionable within the flanged portion 64 as illustrated in FIG. 2 of the drawings. The plurality of second bristles 54 are comprised of a resilient material capable of cleaning the threaded portion 14 of the bolt 12 such as but not limited to metal wire or plastic. The plurality of second bristles 54 preferably extend inwardly from the second outer member 52 and preferably form a second center opening within for receiving the threaded portion 14 of the bolt 12 during cleaning. The second center opening of the second cleaning unit 50 may have various diameters based upon the size of the bolt 12 to be cleaned.

Figure 5:
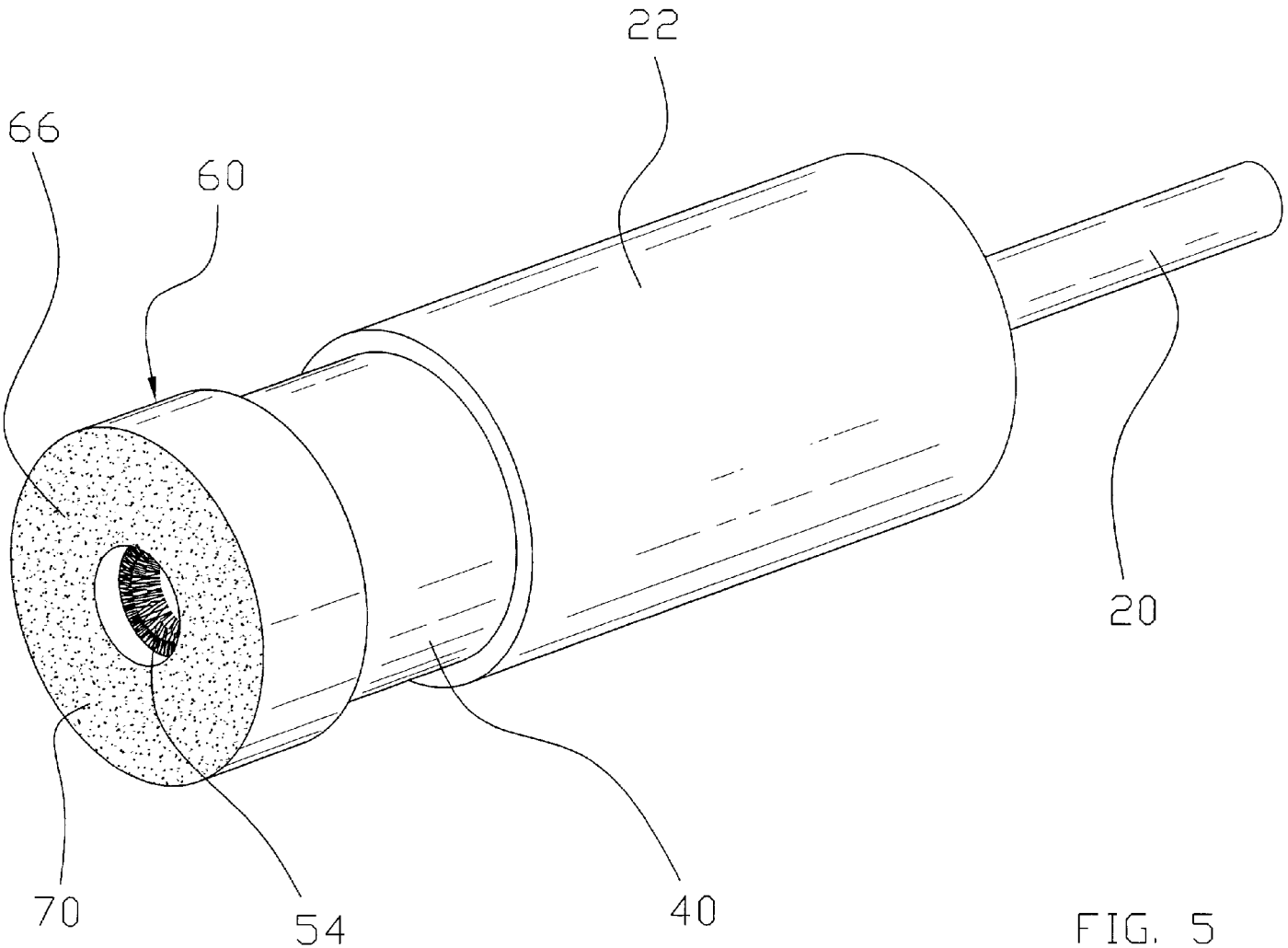
FIG. 5 is an upper perspective view of an alternative embodiment of the present invention using an abrasive member for smoothing concrete around an anchor bolt.
Figure 6:
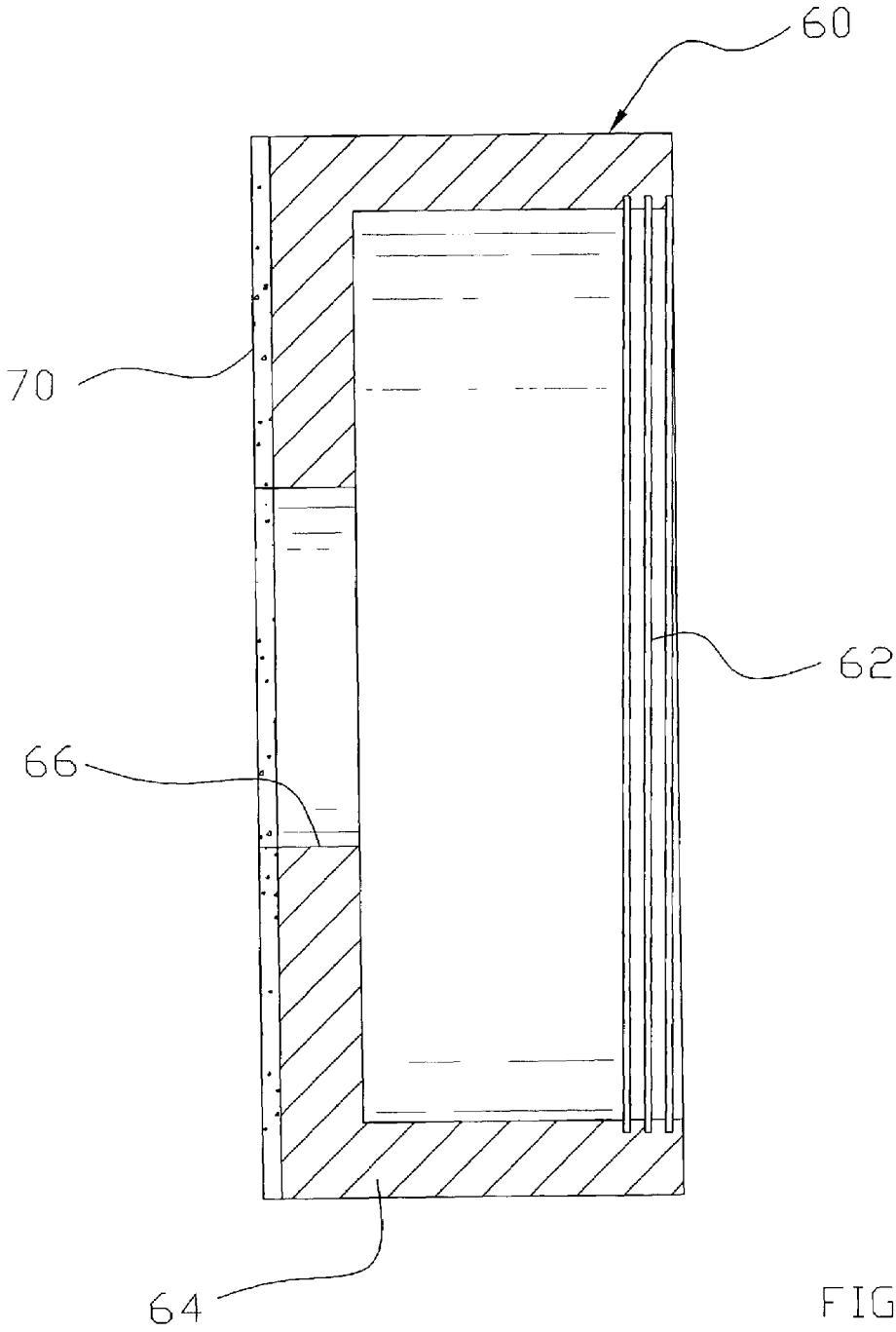
FIG. 6 is a side cutaway view of the distal end member of the alternative embodiment.

FIGS. 5 and 6 illustrate an alternative embodiment using an abrasive member 70 attached to the flanged portion 64 of the outer member 60 for cleaning concrete surrounding the bolt 12. It should be noted that one or more cleaning units 30 may be used within the present invention. It should also be noted that the present invention may be comprised of a single housing structure with the cleaning units 30, 50 non-removably positioned within.

In use, the user positions the bolt 12 cleaning system about the threaded portion 14 of the bolt 12 to be cleaned by inserting the same within the center openings of the cleaning units 30, 50. The user then operate the drive unit 16 which rotates the bolt 12 cleaning system 10. During rotation thereof, the bristles 34, 54 engage the threaded portion 14 thereby removing undesirable debris. After finishing cleaning of the bolt 12, the user then proceeds to the next bolt 12 to be cleaned. When the bristles 34, 54 of the cleaning units 30, 50 become worn, the user simply replaces the cleaning units 30, 50 thereby reducing waste and reducing the cost to operate the bolt 12 cleaning system 10 over extended periods of time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

| Index of Elements for Bolt Cleaning System | |
|---|---|
| ☐ | ENVIRONMENTAL ELEMENTS |
| ☐ | |
| ☐ | |
| ☐ | |
| ☐ | |
| ☐ | |
| ☐ | |
| ☐ | |
| ☐ | |
| ☐ | |
| ☐ | 10. Bolt Cleaning System |
| ☐ | 11. |
| ☐ | 12. Bolt |
| ☐ | 13. |
| ☐ | 14. Threaded Portion |
| ☐ | 15. |
| ☐ | 16. Drive Unit |
| ☐ | 17. |
| ☐ | 18. |
| ☐ | 19. |
| ☐ | 20. Shaft Member |
| ☐ | 21. |
| ☐ | 22. Inner Member |
| ☐ | 23. |
| ☐ | 24. Annular Member |
| ☐ | 25. |
| ☐ | 26. First Inner Threading |
| ☐ | 27. |
| ☐ | 28. |
| ☐ | 29. |
| ☐ | 30. First Cleaning Unit |
| ☐ | 31. |
| ☐ | 32. First Outer Member |
| ☐ | 33. |
| ☐ | 34. First Bristles |
| ☐ | 35. |
| ☐ | 36. |
| ☐ | 37. |
| ☐ | 38. |
| ☐ | 39. |
| ☐ | 40. Connector Member |
| ☐ | 41. |
| ☐ | 42. First Outer Threading |
| ☐ | 43. |
| ☐ | 44. Second Outer Threading |
| ☐ | 45. |
| ☐ | 46. |
| ☐ | 47. |
| ☐ | 48. |
| ☐ | 49. |
| ☐ | 50. Second Cleaning Unit |
| ☐ | 51. |
| ☐ | 52. Second Outer Member |
| ☐ | 53. |
| ☐ | 54. Second Bristles |
| ☐ | 55. |
| ☐ | 56. |
| ☐ | 57. |
| ☐ | 58. |
| ☐ | 59. |
| ☐ | 60. Outer Member |
| ☐ | 61. |
| ☐ | 62. Second Inner Threading |
| ☐ | 63. |
| ☐ | 64. Flanged Portion |
| ☐ | 65. |

-continued

| Index of Elements for Bolt Cleaning System | |
|---|---|
| ☐ | 66. Receiver Opening |
| ☐ | 67. |
| ☐ | 68. |
| ☐ | 69. |
| ☐ | 70. Abrasive Member |
| ☐ | 71. |
| ☐ | 72. |
| ☐ | 73. |
| ☐ | 74. |
| ☐ | 75. |
| ☐ | 76. |
| ☐ | 77. |
| ☐ | 78. |
| ☐ | 79. |

I claim:

1. A bolt cleaning system for cleaning a threaded portion of a bolt, comprising:

a shaft member;

an inner member attached concentrically to said shaft member, wherein said inner member has a tubular structure;

a first cleaning unit removably positioned within an open end of said inner member;

a connector member removably attached to said inner member opposite of said shaft member;

an outer member removably attached to said connector member opposite of said inner member, wherein said outer member has a receiver opening for receiving said threaded portion of said bolt; and a second cleaning unit removably positioned within an end of said outer member.

2. The bolt cleaning system of claim 1, wherein said first cleaning unit and said second cleaning unit are each comprised of an outer member and a plurality of bristles extending inwardly from said outer member forming a center opening.

3. The bolt cleaning system of claim 2, wherein said center opening has a circular shape.

4. The bolt cleaning system of claim 2, wherein said plurality of bristles are comprised of a resilient material.

5. The bolt cleaning system of claim 4, wherein said plurality of bristles are comprised of a metal wire.

6. The bolt cleaning system of claim 1, wherein said outer member has a flanged portion surrounding said receiver opening.

7. The bolt cleaning system of claim 6, including an abrasive member attached to said flanged portion.

8. The bolt cleaning system of claim 1, wherein said connector member has a first outer threading that is threadably connectable to a first inner threading of said inner member, and wherein said connector member has a second outer threading that is threadably connectable to a second inner threading of said outer member.

9. The bolt cleaning system of claim 8, wherein said inner member includes an annular member.

10. The bolt cleaning system of claim 9, wherein said annular member has an inner diameter smaller than an outer width of said first cleaning unit.

* * * * *